US008770785B2

(12) United States Patent
Vermeland et al.

(10) Patent No.: US 8,770,785 B2
(45) Date of Patent: Jul. 8, 2014

(54) WATER RESISTANT LIGHTING FIXTURE

(75) Inventors: Lloyd E. Vermeland, Sandwich, IL (US); Daniel P. Slabek, Chicago, IL (US); Pawel Kwak, Chicago Ridge, IL (US)

(73) Assignee: 555 International, Inc., Chicago, IL (US)

( * ) Notice: Subject to any disclaimer, the term of this patent is extended or adjusted under 35 U.S.C. 154(b) by 494 days.

(21) Appl. No.: 13/228,773

(22) Filed: Sep. 9, 2011

(65) Prior Publication Data

US 2013/0063934 A1 Mar. 14, 2013

(51) Int. Cl.
*F21V 13/04* (2006.01)
*F21V 31/00* (2006.01)

(52) U.S. Cl.
CPC ..... *F21V 31/005* (2013.01)
USPC ..... 362/217.05; 362/249.02; 362/217.02; 362/222; 362/223; 362/101

(58) Field of Classification Search
CPC ..... F21V 31/005
USPC ..... 362/217.02, 217.05, 222, 223, 101
See application file for complete search history.

(56) References Cited

U.S. PATENT DOCUMENTS

| | | | | |
|---|---|---|---|---|
| 7,857,482 | B2 * | 12/2010 | Reo et al. | 362/225 |
| 8,292,449 | B2 * | 10/2012 | Poissonnet et al. | 362/101 |
| 8,322,881 | B1 * | 12/2012 | Wassel | 362/247 |
| 2010/0027269 | A1 * | 2/2010 | Lo et al. | 362/294 |
| 2011/0002120 | A1 * | 1/2011 | Song et al. | 362/249.02 |

* cited by examiner

*Primary Examiner* — Anabel Ton
(74) *Attorney, Agent, or Firm* — Edward J. Chalfie

(57) ABSTRACT

A lighting fixture is provided that includes a flat elongated base having opposing longitudinal marginal slots and a pair of upright walls inboard of the longitudinal slots, and a pair of end caps engaging opposing ends of the elongated base. A gasket extends along a longitudinal surface of each of the upright walls. A lens extends between opposing end caps and conforms to the curved marginal edges of the end caps and edges and upright walls. The lens has two opposing longitudinal grooves that align with a pair of side rails extending between the end caps. Each side rail has a longitudinal cam projection extending into the associated lens groove. When the side rails are tightened against the lens, the cam projections tighten the lens into contact with the gasket to form a water tight seal between the lens and the base.

20 Claims, 2 Drawing Sheets

UNISTRUT MOUNTING BRACKET
WIRING K.O 10
20
12
18
22
14
16
SIDE RAIL (38)
DETAIL A PIVOT AREA
38
32
BASE EXTRUSION
26
FUSE BRACKET
MOUNTING SCREWS

REFLECTOR (24)
40
SIDE GASKET (36)
SIDE RAIL
BASE EXTRUSION
CROSS SECTION
MOUNTING NUTS
UNISTRUT
MOUNTING HOLES
HOLES FOR FLUORESCENT LAMP SOCKETS
LENS
(28) LED

LENS
LED STRIP
REFLECTOR (24)
SOCKET GASKET (50)
END CAP (30)
SOCKET PLATE (40)
SOCKET PLATE GASKET (58)
SIDE GASKET (36)
SIDE RAIL (22)
LED DRIVER
BASE EXTRUSION
CROSS SECTION

WATER RESISTANT LIGHTING FIXTURE

FIELD OF THE INVENTION

The field of the invention relates to lighting fixtures and more particularly to lighting fixtures having water resistant enclosures for use in hostile environments.

BACKGROUND OF THE INVENTION

Lighting fixtures are an important part of any home, commercial or industrial setting. Without adequate light from such fixtures, people could not work or live as conveniently as we do today.

However, some environments are hostile to conventional lighting fixtures. One example is any area where water impinges on the lighting fixture. In such cases, water may impinge on the lighting fixture because of wind blown rain or some sort of industrial or commercial process that requires the use of a high pressure water spray.

In general, the risk inherent in such cases relates to the fact that electricity and water are incompatible. Where water penetrates a lighting fixture the moisture may cause a fire. Alternatively, incident moisture may corrode the fixture, rendering it inoperative.

The protection of enclosures against the ingress of dirt or against the ingress of water is defined in IEC529 (BSEN60529:1991), promulgated by the International Electrotechnical Commission. The degrees of protection are commonly expressed as "IP" followed by two numbers, e.g. IP65, where the numbers define the degree of protection. The first digit (Foreign Bodies Protection) shows the extent to which the equipment is protected against particles, or to which persons are protected from enclosed hazards. The second digit (Water Protection) indicates the extent of protection against water. In this example, for a rating of "IP 65," the first digit "6" indicates that the enclosure is dustproof, and the second digit "5" indicates that the enclosure protects against high-pressure jets from all directions. IP65 is the rating required for satisfactory protection in car washing facilities and similar environments.

Prior efforts to exclude water from lighting fixtures have primarily been limited to incandescent or compact fluorescent light (CFL) fixtures. This has proved to be the most practical because of the compact nature of such devices and because the compact nature of such devices makes it easy to construct a globe that may be used to easily cover such devices. In these cases, the globe may be provided with a set of threads that engages a socket disposed around the incandescent or CFL socket.

However, many applications require the use of fixtures that accept 2-foot, 4-foot and 8-foot long fluorescence bulbs. This is the case because of the need for high levels of illumination at a work surface, because of a high ceiling or because of the need to achieve a uniform illumination level at the work surface. However, in the past, it has not been possible to produce a fixture that accepts such light sources because it was not possible to seal such fixtures against moisture. Accordingly, a need exists for better ways of constructing such fixtures.

DETAILED DESCRIPTION OF AN ILLUSTRATED EMBODIMENT

Figures 1, 2, 3:
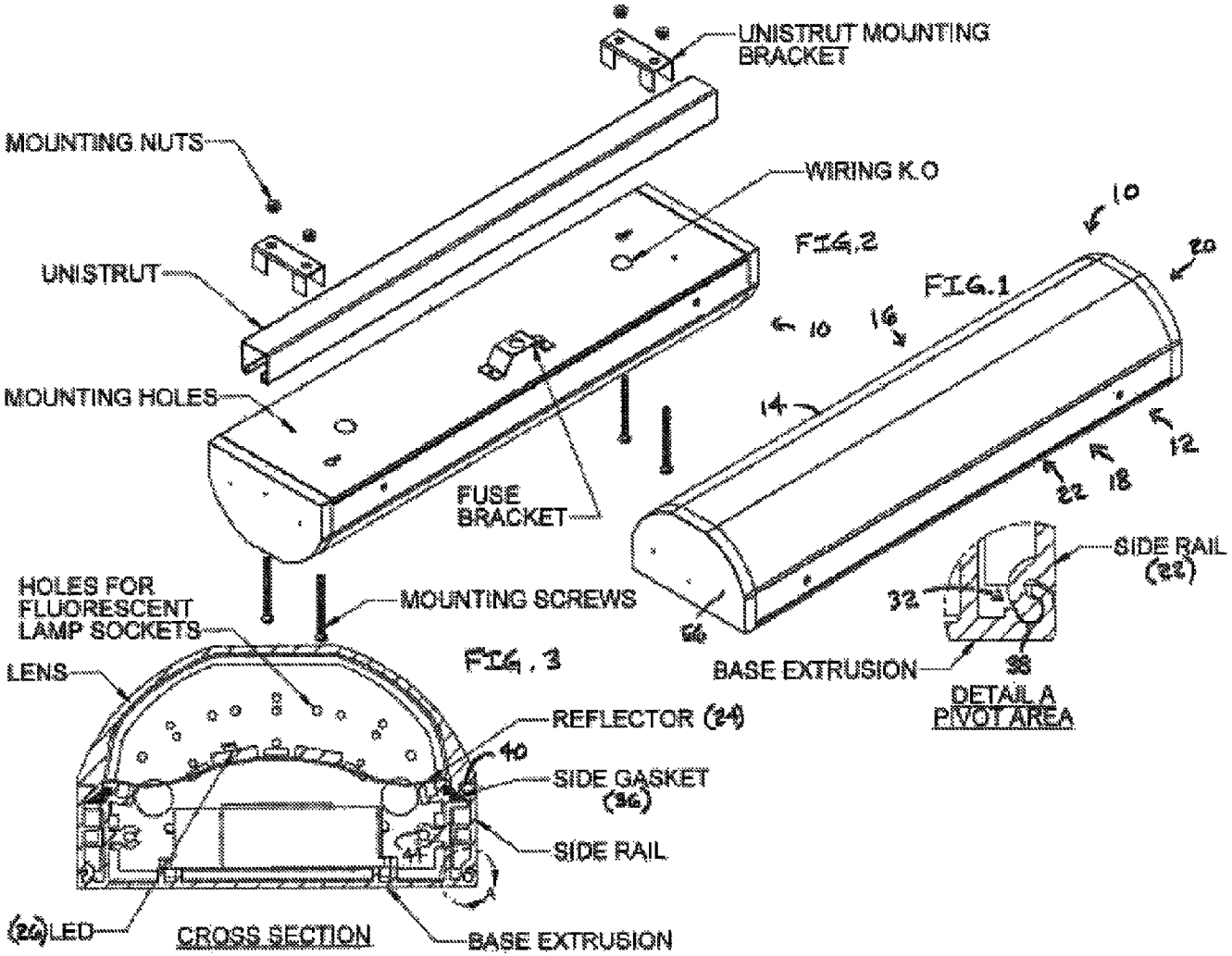
FIG. 1 is a front side perspective view of a lighting fixture 10 shown generally in accordance with an illustrated embodiment of the invention.
FIG. 2 is a rear perspective view of the lighting fixture 10 showing mounting details of the fixture of FIG. 1.
FIG. 3 and Detail A are cut-away views of the fixture of FIG. 1.

FIG. 1 is a front side perspective view of a lighting fixture 10 shown generally in accordance with an illustrated embodiment of the invention. FIG. 2 is a rear perspective view of the lighting fixture 10 showing mounting details.

The fixture 10 generally includes a body 12 and lens 14 that protects a light source 16 covered by the lens 14. The body 12 includes an elongated base 18 and end caps 20 on opposing ends of the base 18. A pair of side rails 22 cooperates with the base 18 and end caps 20 to form a water tight seal between the lens 14 and base 18 and between the lens 14 and end caps 20.

Figures 4, 5:
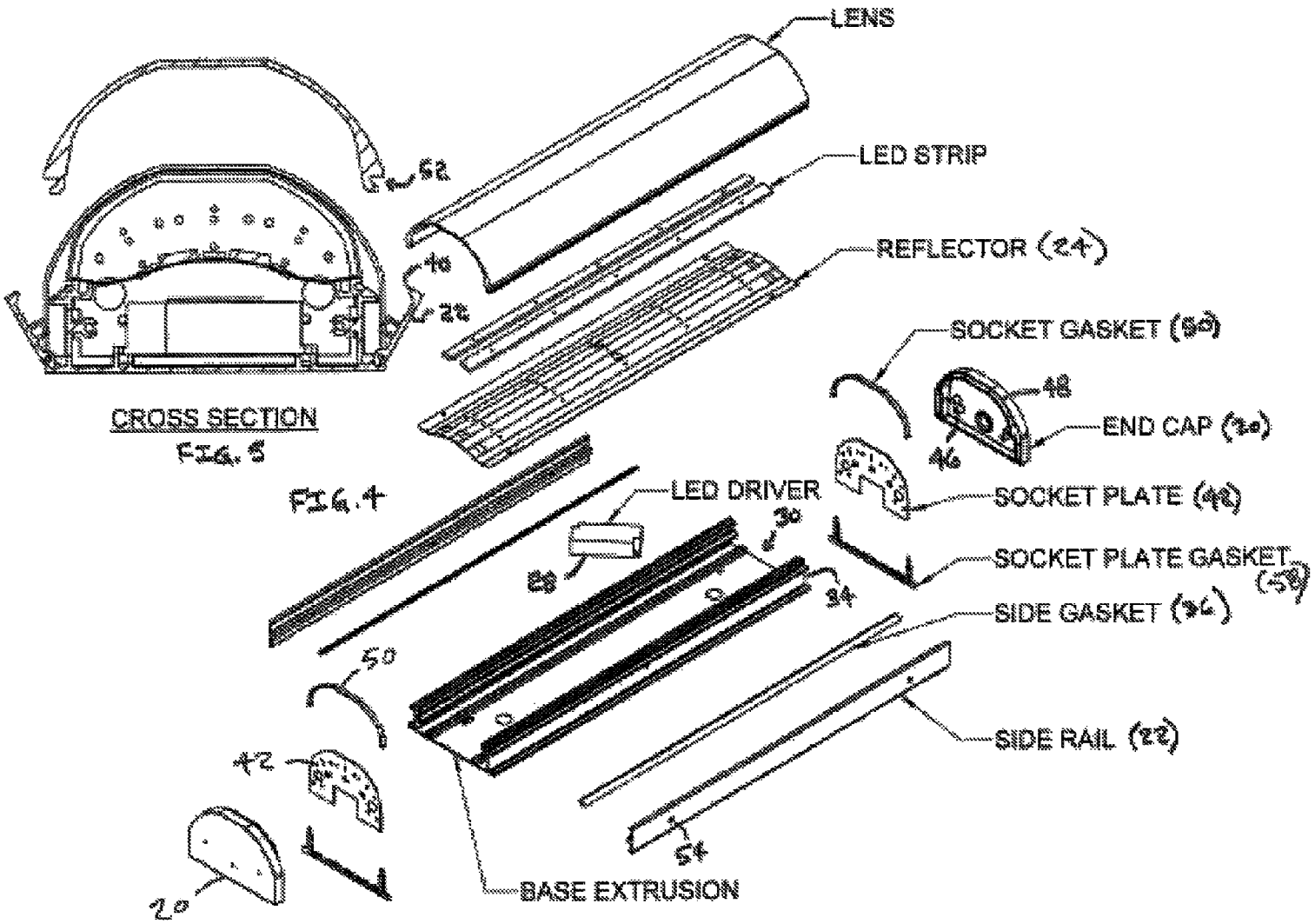
FIG. 4 is an exploded view of the fixture of FIG. 1.
FIG. 5 is an exploded cut-away view of the fixture of FIG. 1.

FIG. 3 is a side cut-away view of the lighting fixture 10 and FIG. 4 is an exploded view of the fixture 10. Included within the fixture 10 is a reflector 24 that is supported by the base 18. The reflector 24, in turn, may support one or more light emitting elements (e.g., light emitting diodes (LEDs)) 26 (FIG. 3) of the light source 16. The LEDs 26 may receive electrical energy from a power supply 28 of the light source 16 located between the reflector 24 and base 18.

The elongated base 18 includes a flat base portion 30 with a slot or groove 32 (Detail A) located along a longitudinal margin edge of the base portion 30. In this regard, the flat base portion 30 may be provided with opposing longitudinal edges folding up and back towards a center of the base portion 30, the folded edges forming and defining a groove 32 extending along the longitudinal edges.

A pair of upright walls 34 located inboard of the slots 32 is shown in FIGS. 3-5 extending in a perpendicular direction away from the flat base portion 30. FIG. 3 shows a pair of ledges shown on the top of the upright walls 34 that define a receptacle for a gasket 36 that extends between the end caps 20. The elongated base 18 may be formed by an extrusion process to define an extruded base 18.

FIG. 3 and Detail A show a pair of projections extending from opposing longitudinal sides of the side rails 22 and where the pair of projections extend along some or all the longitudinal marginal edges of the side rails 22. A projection 38 shown on the lower longitudinal edge of the side rail defines a cylindrical projection formed at and extending along the edge. The cylindrical projection may be inserted into the slot or groove 32. The cylindrical projection 38 and groove 32 forming a hinged joint that allows the side rails 22 to pivot around the slot or groove 32 as shown in the cross-sectional view of FIG. 5.

The pair of end caps 20 include a first marginal edge that engages opposing ends of the elongated base portion 30, with opposing marginal edges of the end caps directly adjacent the first marginal edge engaging the upright walls 34 and with the marginal edge of the end cap opposite the flat base portion curving away from the flat base portion between opposing upright walls. The end caps 20 may be attached to the base portion 18 via a socket plate 42. In this case, a pair of screws may extend through a respective aperture in the socket plate 42, thread into and engage a set of screw holes 44 in the upright walls 34. Similarly, the end caps 20 may be attached to the socket plate 42 via screws extending through the socket plate 42 and thread into screw apertures in the end caps 20. A shoulder 48 on the curved portion of the end caps 20 receive a gasket 50 that extends along the shoulder 48 between upright walls 34.

The lens 14 includes a pair of grooves 52 extending along opposing longitudinal marginal edges. The grooves 52 are complementary to a cam projection 40 formed on the top marginal longitudinal edge of the side rails 22.

Once assembled to the body 12, the lens 14 forms a continuous contact with the gaskets 36 and 50. In this regard, a tapering edge shown on the lower side of the groove 52 is engaged by another tapering edge on the cam projection 40. One or more screws may engage the upright walls 30 through apertures 54 in the side rail 22 tighten the side rails 22 towards the upright walls 34. As the side rails 22 are tightened towards the upright walls by the screws, the mating tapering edges on the lens 14 and cam projection 40 pull the inside surface of the lens into intimate contact with the gaskets 36, 50 thereby creating a water tight seal between the lens 14 and body 12 of the fixture 10.

In general, the fixture 10 offers a number of advantages over prior fixtures. For example, the fixture 10 embodies a sealed unit for wet environments conforming to the IP-65 certification that is resistant to high pressure washing environments (e.g., car washes).

In addition, the sealing method of the unit 10 is unique as the side rails rotate into position to lock the lens tight to unit 10 and to form a seal in the gasket areas. Screws are inserted along the length to hold the side rail tight to the outside of the lens.

The projections 38 on the pivoting side of the side rails 22 slide into the adjoining slots 32 of the main extrusion and allow for greater ease of installing and removing of a lens. This eliminates the loose components that complicate assembly.

The main extrusion 18 is designed to accept a side gasket 36 that extends along the length of the fixture from end cap 20 to end cap 20.

The reflector 24 is designed for assembly of T5 or LED lamping. In addition, the shape of the reflector is such to enhance reflectivity and overall light output of the fixture. The unit 10 accepts T8, T5, or LED lamping with no change required to the basic fixture.

In addition, indentations 56 are provided for drilling and bolting fixtures together, i.e. ganging together. Units can be ganged together to create a continuous lighting fixture.

Decorative endcaps can be specified (replacing the standard flat endcap) for use on the end of a fixture or run of fixtures. An optional occupancy sensor can be installed in the decorative endcap.

The socket plate 42 is designed as a multi-purpose component. First to allow mounting of T8 sockets and secondly a mounting transaction piece to mount the endcap to the main extrusion while sealing the unit with the socket plate gasket 58.

Special mounting brackets allow for external fusing of each fixture 10. The special mounting brackets allow for simplified centered mounting to Unistrut supports.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

We claim:

1. A lighting fixture comprising:

an elongated base, the elongated base have a flat base portion with a slot extending along opposing longitudinal, marginal edges of the base portion and a pair of mutually parallel upright walls extending away from and perpendicular to the flat base portion, the pair of upright walls extending along opposing longitudinal edges of the flat base portion inboard of the longitudinal slots;

a pair of end caps with a first marginal edge of each of the end caps engaging opposing ends of the elongated base portion, with opposing marginal edges of the end caps directly adjacent the first marginal edge engaging the upright walls and with the marginal edge of the end cap opposite the flat base portion curving away from the flat base portion between opposing upright walls;

a gasket that extends along a longitudinal surface of each of the upright walls opposite the base portion and facing away from the other upright wall and also across the curved marginal edge of the end caps between opposing upright walls;

a lens extending between opposing end caps and conforming to the curved marginal edges of the end caps, the lens overlapping and resting on the gasket of the curved marginal edges and upright walls, the lens having a notch extending along a marginal edge parallel to the upright walls; and a pair of side rails extending between the end caps, the rails each having transverse projections extending outwards from opposing longitudinal edges, the projection on a first edge engaging the slot of the base plate and allowing the side rail to pivot in the slot and the projection on the second opposing edge engaging the notch on the lens tightening the lens into contact with the gasket to form a water tight seal between the lens and the side walls and the lens and end caps.

2. The lighting fixture as in claim 1 wherein the elongated base, the flat base portion, the parallel upright walls and slot together further comprise a single extrusion.

3. The lighting fixture as in claim 1 further comprising a slot disposed in the upright walls that receives the gasket.

4. The lighting fixture as in claim 1 wherein the slot angles inwards toward the inboard upright walls.

5. The lighting fixture as in claim 1 wherein the slot and projection on the first edge further comprises a hinge joint connection.

6. The lighting fixture as in claim 1 further comprising a light reflector extending between the end caps and supported by opposing upright walls.

7. The lighting fixture as in claim 1 further comprising a plurality of light emitting diodes supported by the reflector.

8. The lighting fixture as in claim 1 further comprising a socket plate that couples the end caps to the elongated base.

9. The lighting fixture as in claim 1 further comprising a plurality of apertures in the socket plate and corresponding screws, the screws passing through the apertures to secure the socket plate to the upright walls.

10. The lighting fixture as in claim 1 further comprising a plurality of apertures in the socket plate and corresponding screws, the screws passing through the apertures to secure the end caps to the socket plate.

11. The lighting fixture as in claim 10 further comprising a plurality of apertures in the socket plate arranged to receive a socket for a fluorescent bulb.

12. The lighting fixture as in claim 1 wherein the gasket further comprises a plurality of gaskets including a first pair of gaskets that extend of the curved marginal ends of the end caps and a second pair of gaskets that extend along the upright walls.

13. The lighting fixture as in claim 1 wherein the gaskets further comprise EPDM rubber.

14. The lighting fixture as in claim 1 further comprising an IP65 certified enclosure.

15. The lighting fixture as in claim 1 wherein the slot is coextensive with the upright walls.

16. A lighting fixture comprising:

an elongated base extrusion, the elongated base extrusion have a flat base portion with a groove extending along opposing longitudinal, marginal edges and a pair of upright walls extending perpendicularly away from the flat base portion and extending along opposing longitudinal edges inboard of the longitudinal grooves;

a pair of end caps on opposing ends of the elongated base portion, each of the end caps extending between and engaging the upright walls along opposing marginal edges of the end cap and with the flat base portion engaging the end cap along the marginal edge between the upright walls with the marginal edge opposite the flat base portion curving away from the flat base portion between opposing upright walls;

a gasket that extends along a longitudinal surface of the upright walls, the gasket disposed on a side of the upright walls opposite the flat base portion and on an outside surface of opposing upright walls and also across the curved marginal edge of the end caps between opposing upright walls;

a lens extending between opposing end caps and conforming to the curved marginal edge, the lens overlapping and resting on the gasket on the curved marginal edges and upright walls, the lens having a notch extending along a marginal edge parallel to the upright walls; and a pair of side rails extending in a longitudinal direction between the end caps, the rails each having transverse projections extending outwards from opposing longitudinal edges, the projection on a first edge of the opposing longitudinal edges engaging the groove of the base plate and allowing the side rail to pivot in the groove and the projection on the second opposing edge engaging the notch on the lens tightening the lens into contact with the gasket to form a water tight seal between the lens and the side walls and the lens and end caps.

17. The lighting fixture as in claim 16 further comprising a plurality of apertures in each of the pair of side rails and a plurality of screws, the screws secure the side rails to the upright walls.

18. The lighting fixture as in claim 16 further comprising a pair of socket plates and socket plate gaskets, the socket plates secures the end caps to the upright walls.

19. The lighting fixture as in claim 16 further comprising a reflector and a plurality of light emitting diodes secured to the reflector, the reflector supported between the base portion and lens by the upright walls.

20. A lighting fixture comprising:

an elongated base extrusion, the elongated base extrusion have a flat base portion with opposing longitudinal edges folding up and back towards a center of the base portion, the folded edges forming a groove extending along the longitudinal edges and a pair of upright walls extending away from the flat base portion along opposing longitudinal edges inboard of the longitudinal grooves;

a pair of end caps on opposing ends of the elongated base portion, the end caps oriented perpendicular to the flat base portion, the end caps each having a rectangular portion and a semicircular portion extending from the rectangular portion, the rectangular portions engages opposing ends of the flat base portion and upright walls along a marginal edge of the rectangular portion where the semicircular portion extends from the rectangular portion on a side opposite the flat base portion, the semicircular portion forms an arc between opposing corners on one side of the rectangular portion and between outside corners of the upright walls;

a gasket that extends along an outside, top surface of the upright walls and across the semicircular portions between opposing upright walls;

a lens extending between opposing semicircular portions on opposing ends of the elongated base portion and conforming to the semicircular shape of the semicircular portions, the lens overlapping and resting on the gasket on the semicircular portions and top surface of the upright walls, the lens having a notch extending along a marginal edge parallel to the upright walls; and a pair of side rails coextensive with the upright walls, the side rails extending in a longitudinal direction between the end caps, the rails each having transverse projections extending outwards from opposing longitudinal edges, the projection on the first edge engaging the groove of the base plate and allowing the side rails to pivot in the groove and the projection on the second opposing edge engaging the notch on the lens tightening the lens into contact with the gasket to form a water tight seal with the lens along the upright walls and semicircular portions.

* * * * *